United States Patent [19]

Kosrow

[11] Patent Number: 4,785,753

[45] Date of Patent: Nov. 22, 1988

[54] LATCH TACKER

[75] Inventor: Robert L. Kosrow, Hoffman Estates, Ill.

[73] Assignee: Union Special Corporation, Chicago, Ill.

[21] Appl. No.: 68,587

[22] Filed: Jun. 30, 1987

[51] Int. Cl.[4] ..... D05B 53/00

[52] U.S. Cl. ..... 112/253

[58] Field of Search ..... 112/130, 253, 285, 286, 112/287, 288, 294, DIG. 3

[56] References Cited

U.S. PATENT DOCUMENTS

| | | | |
|---|---|---|---|
| 3,698,336 | 10/1972 | Lavner | 112/286 |
| 4,220,105 | 9/1980 | Palacino | 112/287 |
| 4,644,884 | 2/1987 | Tatsumi | 112/130 |
| 4,679,515 | 7/1987 | Keeton | 112/288 X |

*Primary Examiner*—Wm. Carter Reynolds

*Attorney, Agent, or Firm*—Powell L. Sprunger

[57] ABSTRACT

An apparatus for positioning a chain of stitches for stitching onto material in a sewing machine having a needle and a throat plate. The apparatus has a blower for positioning the chain of stitches forwardly of the needle. The apparatus has grasping members for grasping the chain in the forward position. The apparatus also has a cylinder for moving the grasping members between a first position adjacent the throat plate when the chain is being grasped, and a second position away from the throat plate after the chain has been grasped to tighten the grasped chain.

13 Claims, 6 Drawing Sheets

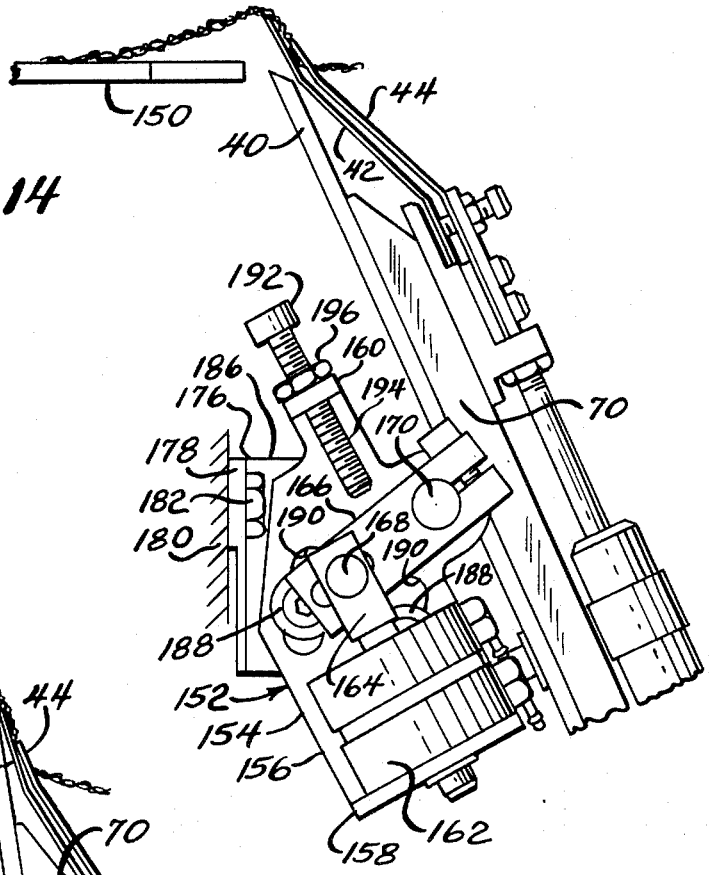
FIG. 14
FIG. 15
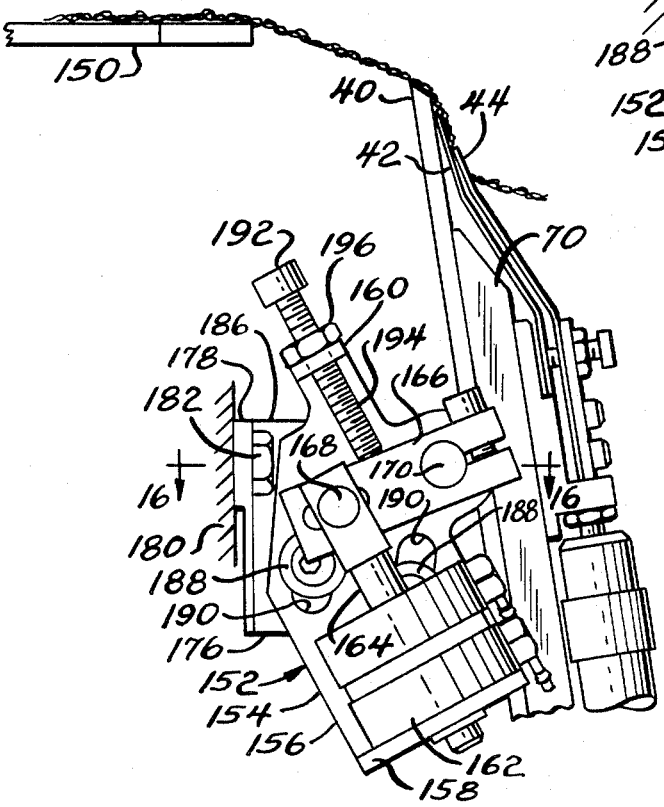
FIG. 16
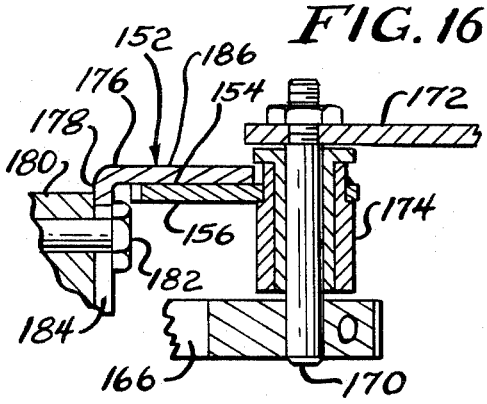
FIG. 17
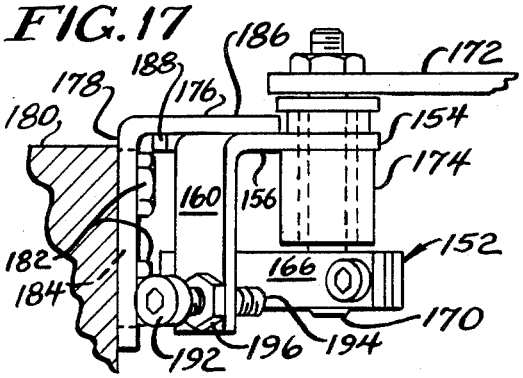

LATCH TACKER

CROSS REFERENCE TO RELATED APPLICATION

This application is related to application Ser. No. 000,269, filed Jan. 2, 1987, and Ser. No. 050,360, filed May 18, 1987.

BACKGROUND OF THE INVENTION

The present invention relates to an apparatus for use with a sewing machine to cut a chain of stitches, trailing from a sewn garment and hold the cut chain in a predetermined location so as to be positioned to be incorporated into the leading portion of the seam of the next garment to be sewn.

Sewing machines that form seams utilizing chain stitches on a succession of pieces of material with the seam-being continued into the area intermediate the pieces of material, are well known. With seams of this type, means are provided for detaching the pieces of material one from the other by appropriate automatic chain-cutting devices after the sewn pieces have been caused to travel beyond the needle and the presser foot of the machine.

By cutting the chain of stitches with these devices, one portion of minimal length remains attached to the stitched piece of material and the other being connected to the throat plate is manipulated to a position forwardly of the needle so that it can be incorporated into the initial portion of the seam that will be formed on the next piece of material or workpiece. This procedure prevents a slackening of the seam's initial stitches which would give the leading edge of the workpiece an undesirable appearance.

The known devices for performing this function include a chain-cutting device disposed adjacent the stitch finger of the throat plate which co-operates with a chain-orienting device and gripper apparatus located forwardly the needle and usually adjacent the forward portion of the throat plate.

These apparatii suffer from the disadvantage that, because the portion of the chain to be sewn onto the next garment is located on the upper surface of the throat plate intermediate the needle hole, the gripping apparatus is frequently accidentally displaced while positioning the next workpiece in the sewing area.

The material to be sewn interferes with the chain, preventing the proper insertion of the latter into the new seam being sewn, due to the pressure and friction of the piece of material of the chain which tend to dislodge it from the gripping apparatus and move it toward the trimmer knife of the machine that is adjacently disposed, thereby hindering subsequent handling of the chain.

A sewing machine to solve these problems is disclosed in application Ser. No. 000,269, filed Jan. 2, 1987, incorporated herein by reference. In this application, a chain of stitches is sewn into the fabric. However, the sewing machine may be utilized with different sized throat plates which project a varying distance toward the gripping apparatus, and it is desirable to make adjustment in order that the gripping apparatus tightens the chain, and if the chain is loose the chain will remain longer on the gripping apparatus during the sewing of a subsequent garment, and an unsightly loose nub may be formed on the subsequent garment. Also, irrespective of the size of the throat plate, it is desirable to tighten the chain due to elasticity of the chain to prevent formation of the loose nub.

The following patents generally relate to this subject matter: U.S. Pat. Nos. 3,490,403, 4,453,481, 4,599,960, 4,599,961, 4,303,030, 4,187,793, 4,038,933, 4,149,478, 4,220,105 3,541,984, and 3,698,336, and British application No. 2,058,858.

SUMMARY OF THE INVENTION

A principal feature of the present invention is the provision of an improved sewing machine.

Accordingly to the present invention, an apparatus is provided for positioning a chain of stitches onto material in the sewing machine having a needle and a throat plate comprising, means for positioning the chain of stitches forwardly of the needle, and means for grasping the chain in the forward position.

A feature of the present invention is the provision of means for moving the grasping means between a first position adjacent the throat plate, and a second position away from the throat plate after the chain has been grasped.

Another feature of the present invention is that the grasping means grasps the chain in the first position.

Yet another feature of the invention is that the grasping means tightens the chain in the second position.

A feature of the present invention is that the grasping means may be utilized with different sized throat plates projecting toward the grasping means and will tighten the chain to compensate for the different sized throat plates.

Still another feature of the invention is that the grasping means tightens the chain irrespective of the size of the throat plate and compensates for elasticity of the chain.

Another feature of the invention is that the tightened chain prevents formation of a loose nub when a subsequent garment is being sewn.

Still another feature of the invention is that grasping means may move away from the throat plate to the second position while the grasping means is being lowered relative to the throat plate.

Yet another feature of the invention is that the grasping means may be moved away from the throat plate to the second position after the grasping means has been lowered relative to the throat plate.

A further feature of the invention is the provision of means for adjusting the location of the second position of the moving means.

Further features will become more fully apparent in the following description of the embodiments of this invention and from the appended claims.

DESCRIPTION OF THE DRAWINGS

In the drawings:

FIG. 14 is a fragmentary elevational view of another embodiment of the present invention in which the gripping apparatus is located adjacent a throat plate during grasping of the chain;

FIG. 15 is a fragmentary elevation view showing the gripping apparatus being moved to a second position away from the throat plate in order to tighten the grasped chain;

FIG. 16 is a sectional view taken substantially as indicated along the line 16—16 of FIG. 15; and FIG. 17 is a fragmentary upper plan view of a device for moving the gripping apparatus from the first to second position.

DESCRIPTION OF THE PREFERRED EMBODIMENTS

As the general construction and operation of a sewing machine, which may be of Federal Stitch Type 504, to which the present invention is applicable, is well known and familiar to those conversant in the art, and as the invention is primarily concerned with a device for positioning and gripping a chain of stitches for incorporation into the initial stitches of a new seam, it is only considered necessary here to illustrate and describe those parts which are directly concerned with a preferred form of the invention.

Figure 1:
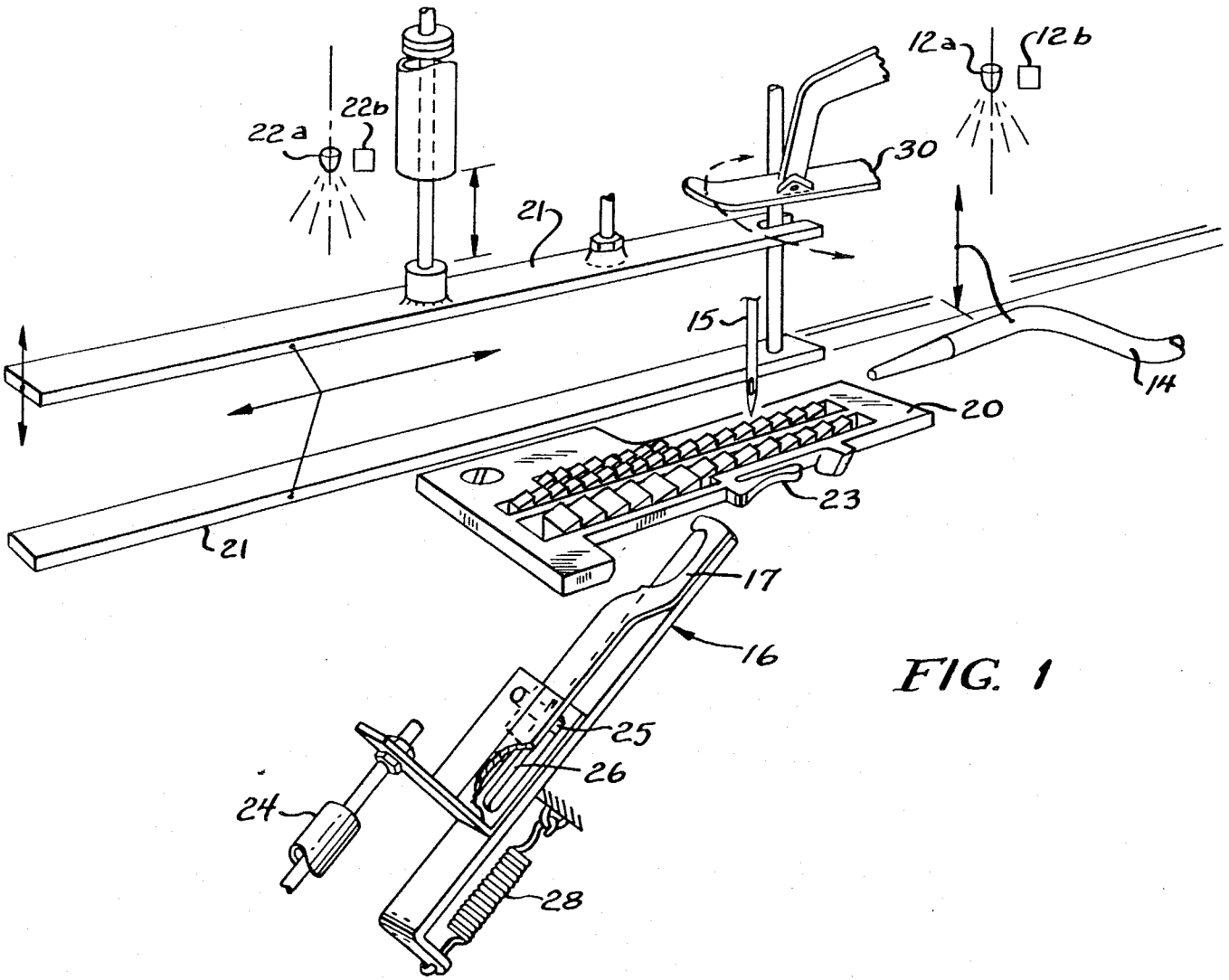
FIG. 1 is a schematic perspective view of an embodiment of a sewing machine of the present invention.
Figure 2:
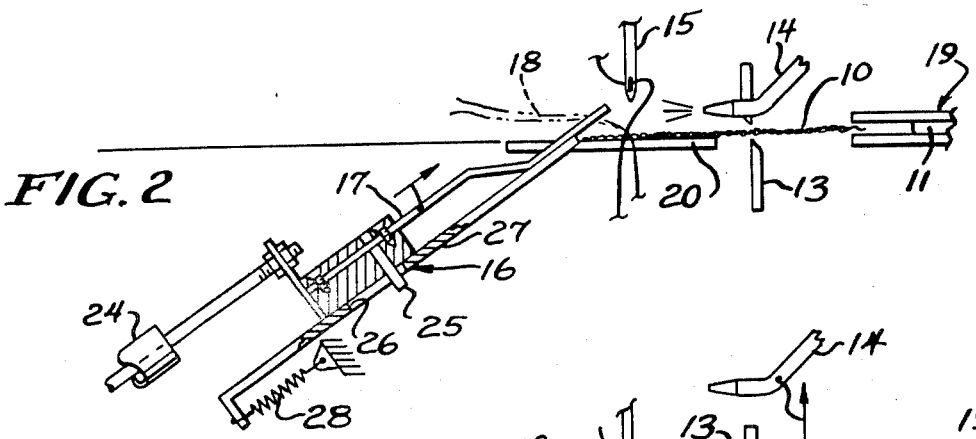
FIG. 2–5 illustrate the cycle of operation of the machine of FIG. 1.

As shown in FIGS. 1 and 2, after the chain 10 is sewn onto the material 11, the clamp 21 moves away from the needle 15 and presser foot 30 and pulls the threads off the stitch finger or tongue 23. Light is emitted by light emitter 12*a*, and light detector 12*b* senses a change of reflectivity from a lower surface, such that the detector 12*b* senses the end of the material in response to which the cutter 13 severs the chain 10. The positioning means, in the form of a blower 14, directs a stream of air onto the severed chain to blow it back forwardly of the needle 15, as shown by the phantom chain 18. Alternatively, the machine may have a plurality of blowers to sequentially move the chain forwardly of the needle. The gripping means or apparatus 16 is activated, and the hook member 17 rises to hook around the severed chain 18.

Figure 3:
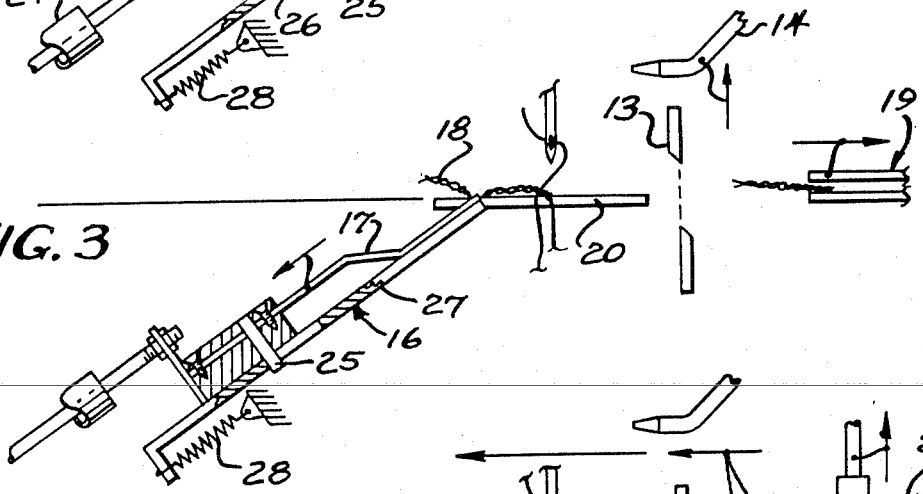

As shown in FIG. 3, the cutter 13 opens with the material feed mechanism 19 moving the sewn material to a conveyor (not shown).

The blower 14 shuts off and is raised. The hook member 17 returns to below the throat plate 20, clamping the severed chain in the gripping means 16.

Figure 4:
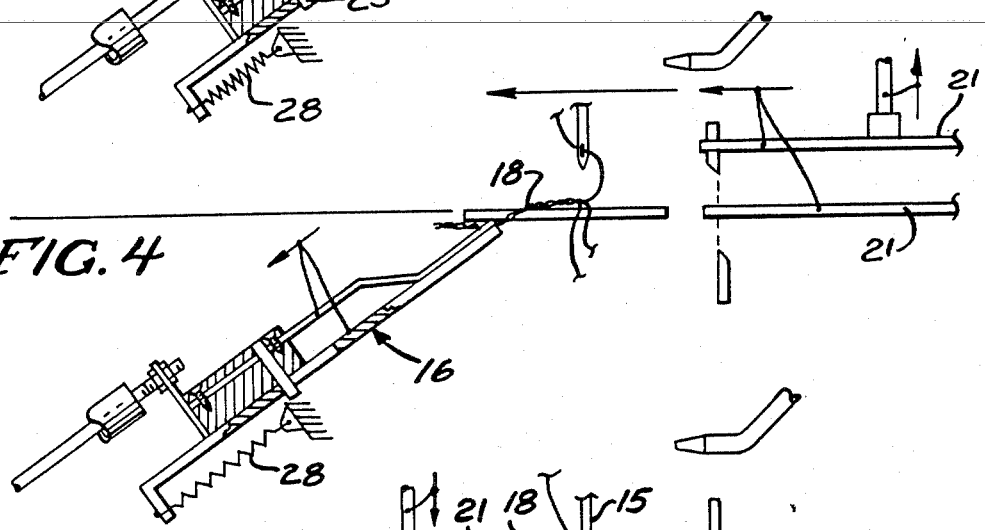
Figure 5:
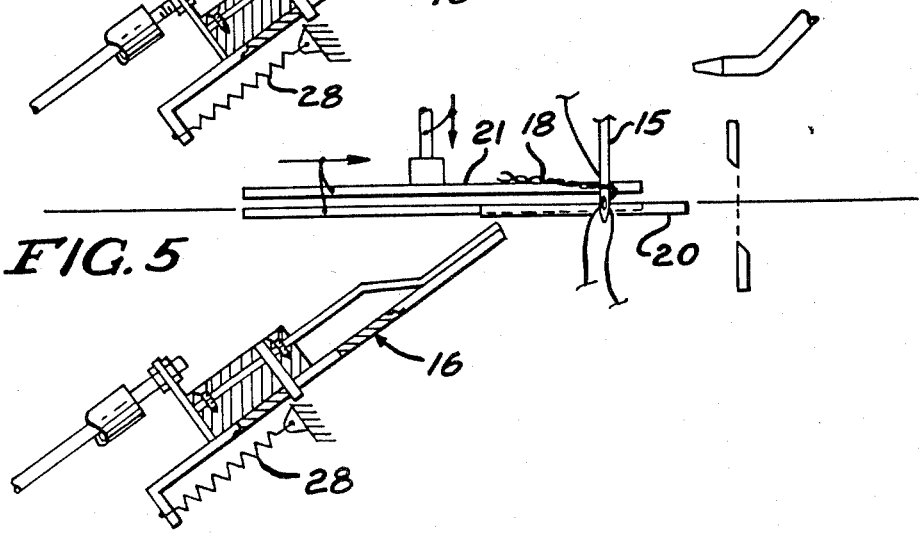

As shown in FIG. 4, the clamp 21 opens, and the released garment is removed by the conveyor, with the clamp 21 returning to its starting position forwardly of the needle 15. Meanwhile, the gripping means 16 moves further below the throat plate 20, tensioning the chain 18. Light is emitted by light emitter 22*a*, and light detector 22*b* senses a change of reflectivity from a lower surface. When material is sensed by the detector 22*b*, the clamp 21 closes and the material is fed to the sewing machine, while the chain 18 is held in tension by the gripping means 16 for the initial stitching of the seam, to prevent slackening of the seam's initial stitches which would give the leading edge of the material an undesirable appearance.

Figure 13:
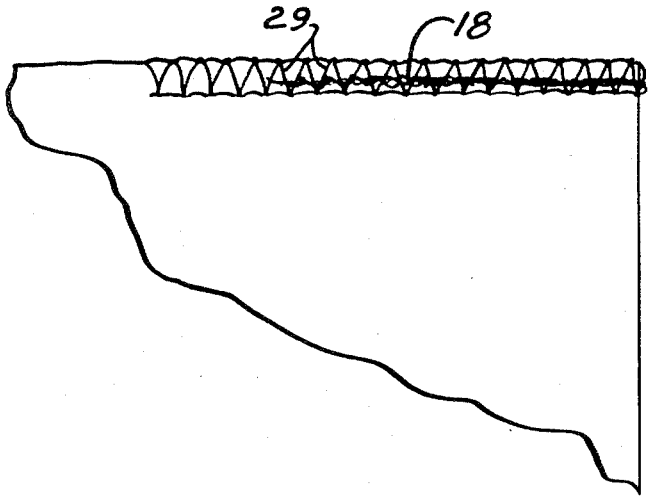
FIG. 13 is a fragmentary plan view of a fabric stitched with the sewing machine of the present invention.

As the material 11 is moved across under the needle 15 by the material feed mechanism 19, the end of the chain is pulled from the gripping means 16 and the chain 18 is sewn into the seam, and the cycle is repeated. The resulting sewn fabric is shown in FIG. 13 in which the chain 18 is shown beneath the seaming or overedge stitches 29.

The gripping means 16 is operated by a single pneumatic cylinder 24 which is directly connected to the hook member 17. When the piston of the cylinder 24 pushes the hook member 17 upwardly, as shown in FIG. 2, an extension 25 slides in a slot 26 of member 27 of the gripping means. Upon the hook member 17 being withdrawn, as shown in FIG. 3, the extension 25 slides in the slot 26 to then abut against the member 27, whereby both the member 27 and the hook member 17 are withdrawn further below the throat plate 20 against the biasing force of the spring 28, as shown in FIG. 4. Upon the hook member 17 starting its upward motion, the spring 28 returns the member 27 to its initial position below the throat plate 20.

Thus, the present invention, at all times, provides an apparatus for the cutting and the positioning of a chain stitch which ameliorates the problems of the prior art, by providing a mechanical gripping means 16 which holds the severed chain below the level of the throat plate, with the gripping means 16 being movable between positions below and above the throat plate 20.

In an alternative form, the light emitter 12*a* and light detector 12*b* may be omitted, and a time delay may be initiated or stitches may be counted after light detector 22*b* senses the material in order to activate the cutter 13.

Figure 6:
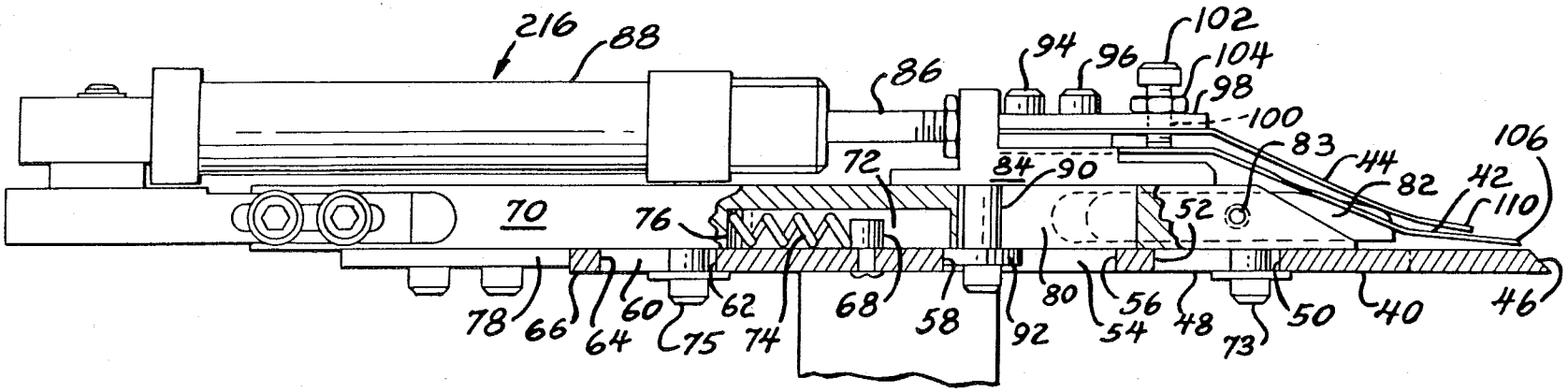
FIG. 6 is a side elevational view; partly broken away, of another embodiment of gripping apparatus for the sewing machine of FIG. 1.
Figure 7:
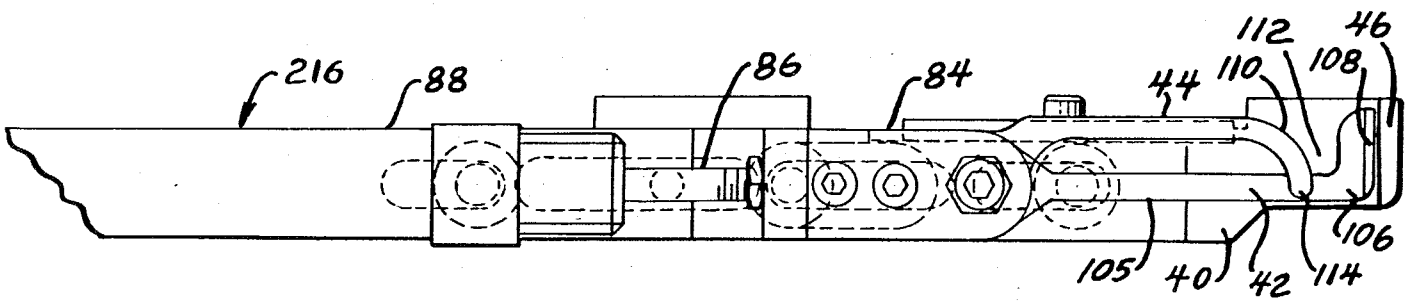
FIG. 7 is a fragmentary top plan view of the gripping apparatus of FIG. 6.
Figure 8:
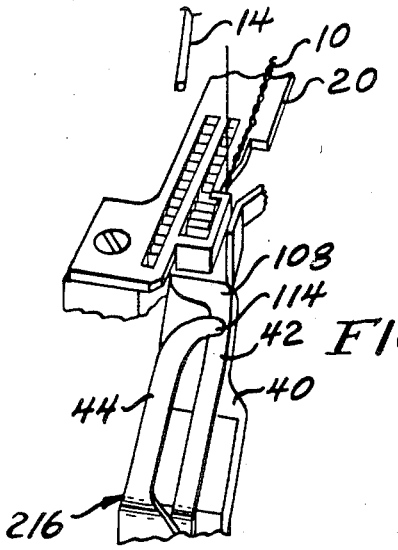
FIG. 8–12 are fragmentary perspective views showing operation of the gripping apparatus of FIGS. 1–7.

Another embodiment of the gripping apparatus 216 is shown in FIGS. 6–12. With reference to FIGS. 6–8, the gripping apparatus 216 has an elongated lower plate 40, an elongated nipper 42, and an elongated guide 44.

The plate 40 has a forward beveled edge 46, a first elongated slot 48 with opposed first and second ends 50 and 52, a second elongated slot 54 with first and second ends 56 and 58, and an elongated third slot 60 with first and second ends 62 and 64. The plate 40 also has a rearward end 66. The plate 40 has an upwardly directed pin 68 for a purpose which will be described below.

The gripping apparatus 216 has a stationary member 70 having a cavity 72 facing the plate 40. A helical spring 74 is received in the cavity 72 and extends between one end 76 of the cavity 72 and the pin 68 of plate 40. In this configuration, the spring 74 is compressed and thus biases the plate 40 forwardly through the pin 68. The stationary member 70 has a rear stop 78 which bears against rearward end 66 of the plate 40 in this configuration of the gripping apparatus 16. The stationary member 70 has an elongated slot 80 extending therethrough and communicating with the second slot 54 of the plate 40. The stationary member 70 also has a forwardly directed cam 82 for a purpose which will be described below. The cam 82 is slidable in the stationary member 70, and may be secured at a desired position by a screw 83.

The gripping apparatus 216 has a movable retaining member 84 connected to and driven by the piston 86 of a cylinder 88. The retaining member 84 has a depending pin 90 extending through slot 80 of stationary member 70 and having a washer 92 received in the second slot 54 of plate 40. The retaining member 84 has a pair of screws 94 and 96 which fixedly secure rearward ends of the resilient nipper 42 and resilient guide 44 to the retaining member 84. The retaining member 84 has a forwardly directed flange 98 having a threaded aperture 100 to receive a screw 102 containing a nut 104 above the flange 98. The outer end of screw 102 bears upon the nipper 42 to bias the nipper 42 toward the plate 40. The screw 102 and nut 104 are adjustable in flange 98, such that the screw 102 may exert an adjustable bias against nipper 42 to accommodate different diameter sizes of threads.

The nipper 42 has an elongated bar 105 connected to a forward end 106 having an outwardly directed finger 108, with the forward end 106 being located near or against the plate 40.

The guide 44 has a forward curved end portion 110 spaced from the finger 108 of the nipper 42 to define a space 112 between the nipper finger 108 and end portion 110 of the guide 44. An outer end 114 of the guide 44 is located above the bar 105 of the nipper 42. In the configuration shown, the guide 44 bears against the cam 82 which raises the end 114 of the guide 44 from the nipper 42 for a purpose which will be described below. When the nipper 42 and guide 44 are moved forwardly by the retaining member 84, as will be described below, the guide 44 becomes disengaged from the cam 82 causing the end 114 of resilient guide 44 to engage against the bar 105 of nipper 42 causing further bias of the nipper 42 against the plate 40.

Figure 9:
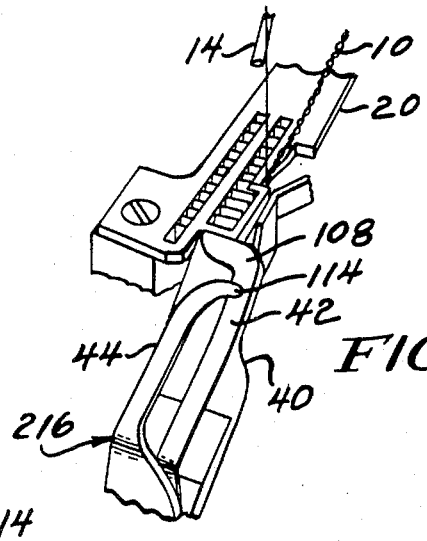

In operation, prior to severing the chain 10, the plate 40, nipper 42, and guide 44 are all located beneath the throat plate 20, as shown in FIG. 8, with the forward end of the nipper 42 located adjacent the forward end of the plate 40. With reference to FIGS. 6, 7, and 9, shortly before or after the chain 10 is severed, the cylinder 88 is activated causing forward movement of the retaining member 84 and retained nipper 42 and guide 44. At the same time, the pin 90 moves forwardly in the slot 80 of the stationary member 70, and the moving washer 92 permits forward movement of the spring biased plate 40 to a location with the beveled edge 46 located adjacent the throat plate 20. At this time, the screw 73 of stationary member 70 strikes the second end 52 of first slot 48 and the screw 75 of stationary member 70 strikes the second end 64 of third slot 60, thus preventing further forward movement of the plate 40 past the throat plate 20. However, with reference to FIGS. 6, 7, and 10, the cylinder 88 continues to drive the retaining member 84, thus moving the retained nipper 42 and guide 44 above the throat plate 20, while the pin 90 leaves the second end 58 of the second slot 54, since the plate 40 is no longer free to move forwardly past the throat plate 20.

Figure 10:
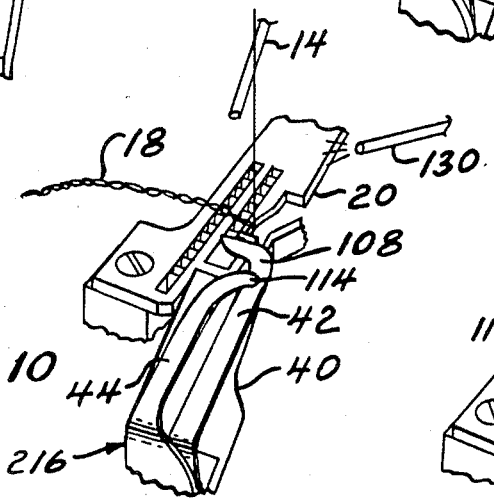
Figure 11:
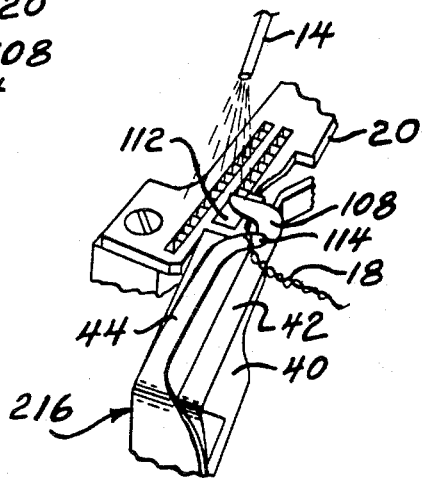

In this configuration of the gripping apparatus 216, the severed chain 18 is first moved to one side of the needle by a first blower 130, as shown in FIG. 10, and is then moved by the blower 14 into the space 112 between the nipper 42 and guide 44, with the curved guide 44 directing the chain 18 into the space 112, as shown in FIG. 11.

At this time, the cylinder 88 begins to retract the nipper 42 and guide 44 until the forward end of the nipper 42 is located adjacent the forward end of the plate 40 at the level of the throat plate 20. The severed chain 18 thus becomes caught between the finger 108 of the nipper 42 and the forward portion of the plate 40. Also, at this time, the washer 92 again engages against the second end 58 of second slot 54, and further retraction of the retaining member 84 also causes retraction of the plate 40 along with the nipper 42 and guide 44.

As previously discussed, when the guide 44 leaves the cam 82, the outer end 114 of the guide 44 is biased against the nipper 42 to apply an increased bias to the nipper 42 against the plate 40 in order to draw the chain 18 taut as the nipper 42 and guide 44 move beneath the throat plate 20.

Figure 12:
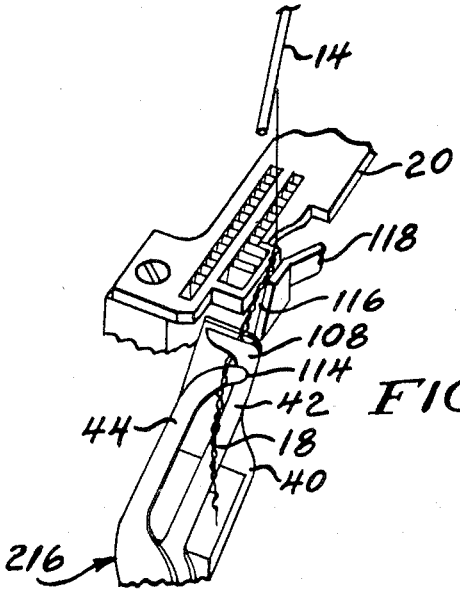

The cylinder continues to retract the nipper 42 and guide 44 beneath the throat plate 20, while driving the plate 40 through pin 90 to the configuration shown in FIG. 12 with the gripping apparatus 216 beneath the throat plate 20, with the chain 18 located in a groove 116 between the throat plate 20 and a conventional fabric cutter 118, and with the plate 40 striking the stop 78. At this time, the guide 44 engages the cam 82, and the end 114 of guide 44 becomes disengaged from the nipper 42 to provide a lessened bias between the nipper 42 and plate 40. Although the chain 18 is drawn taut beneath the top of throat plate 20, the lessened bias of the nipper 42 permits easy removal of the chain 18 from the nipper 42 and plate 40 to prevent distortion of the first few stitches of the next sewn fabric. As previously discussed, the chain 18 is released from the gripping apparatus as the next fabric is sewn over the chain resulting in the sewn fabric of FIG. 13.

Another embodiment according to the present invention is illustrated in FIGS. 14–17, in which like reference numerals designate like parts. In this embodiment, the sewing machine has a throat plate 150, a lower plate 40, a nipper 42, and a guide 44, as previously described. In this embodiment, the cam 82 may be omitted, if desired.

The sewing machine has a device 152 for moving the grasping apparatus toward and away from the throat plate 150. The device 152 has a first bracket 154 with a first elongated plate 156 and a second plate 158 extending generally at right angles to the first plate 156. The first bracket 154 has a third plate 160 extending generally at right angles to the first plate 156 at a far end of the first plate 156 relative to the second plate 158 for a purpose which will be described below.

The device 152 has a cylinder 162 mounted on the second plate 158. The device 152 has a piston 164 extending from the cylinder 162 and being movable between a retracted and extended position by the cylinder 162. The outer end of the piston 164 is pivotally mounted on one end of a lever 166 by a pin 168 which extends through the piston 164 and lever 166. The other end of the lever 166 is fixedly secured to one end of a pivot pin 170. The other end of the pin 170 is fixedly secured to a plate 172 which is attached to a lower end of the stationary member 70. As shown, the pin 170 is pivotally mounted in a bushing 174.

The device 152 has a second bracket 176 having a first plate 178 which is mounted to the sewing machine housing 180 by a pair of screws 182 which extend through an elongated slot 184 in the first plate 178. The second bracket 176 has a second plate 186 extending generally at right angles to the first plate 178. The first plate 156 of the first bracket 154 is secured to the second plate 186 of the second bracket 176 by a pair of screws 188 which extend through elongated slots 190 in the first plate 156 into the second plate 186 of the second bracket 176. The third plate 160 of the first bracket 154 has an elongated screw 192 extending through the third plate 160 in a manner such that an outer end 194 of the screw 192 may be adjusted relative to the lever 166 in combination with a nut 196 which is tightened on the screw 192.

In use, the piston 164 is located in the retracted position as shown in FIG. 14, by the cylinder 162, such that the piston 164 moves the lever 166, pin 170, plate 172, and the stationary member 70 of the gripping apparatus to a first position in which the lower plate 40 and gripping apparatus are located adjacent the throat plate 150 when the chain is being grasped by the nipper 42 and guide 44. At a time when the gripping apparatus is being lowered or has been lowered relative to the throat plate 150, the cylinder 162 moves the piston 164 to the extended location, such that the piston 164 moves the lever 166, pin 170, plate 172, and stationary member 70 as well as the grasping apparatus, to a second position away from the throat plate 150 in order to tighten the grasped chain. At this time, the outer end 194 of the screw 192 bears against and stops movement of the lever 166, such that movement of the lever 166 in the second position of the grasping device may be modified through adjustment of the screw 192.

In this manner, throat plates 150 of varying size projecting toward the grasping device may be utilized, while still tightening the grasped chain by the device 152. In addition, the device 152 may be utilized with throat plates 150 of any size while still tightening the chain by the grasping device to compensate for elasticity of the chain to prevent formation of a loose nub in a subsequent garment to be sewn. As previously discussed, the grasping device may be move to the second position while the grasping device is being lowered relative to the throat plate 150, or after the grasping device has been moved to the lower position relative to the throat plate 150. The grasping device may then be later moved by the cylinder 162 from the second position to the first position after the chain has been released by the grasping device for sewing of a subsequent garment.

The lateral position of the grasping device may be modified relative to the throat plate 150 by suitable adjustment of the first plate 178 of the second bracket 176 by moving the slot 184 along the screws 182. Also, the vertical location cf the grasping device relative to the throat plate 150 may be modified through adjustment of the first plate 156 of the first bracket 154 through movement of the slots 190 of the first plate 156 relative to the screws 192.

The foregoing detailed description is given for clearness of understanding only, and no unnecessary limitations should be understood therefrom, as modification will be obvious to those skilled in the art.

What is claimed is:

1. An apparatus for positioning a chain of stitches for stitching onto material in a sewing machine having a needle and a throat plate, comprising:

means for positioning the chain of stitches forwardly of the needle;

means separate from the positioning means for grasping the chain in the forward position; and means for moving the grasping means between a first position adjacent a forward end of the throat plate when the chain is being grasped, and a second position away from and forward of the throat plate after the chain has been grasped to tighten the grasped chain.

2. The apparatus of claim 1 including means for lowering the grasping means relative to the throat plate after grasping the chain.

3. The apparatus of claim 2 wherein the moving means moves the grasping means from the first to second position while the grasping means is being lowered by the lowered means.

4. The apparatus of claim 2 wherein the moving means moves the grasping means from the first to second position after the grasping means has been lowered by the lowering means.

5. The apparatus of claim 1 including means for adjusting the location of the second position of the moving means.

6. The apparatus of claim 1 including means for adjusting the position of the grasping means laterally relative to the throat plate.

7. The apparatus of claim 1 including means for adjusting the grasping means toward and away from the throat plate in said first position.

8. The apparatus of claim 1 wherein the grasping means comprises, and elongated lower plate, an elongated nipper having a finger, and an elongated guide having an end portion defining a space between the end portion and finger, and in which the moving means pivots the lower plate.

9. An apparatus for positioning a chain of stitches for stitching onto material in a sewing machine having a needle and a throat plate, comprising:

means for positioning the chain of stitches forwardly of the needle;

means separate from the positioning means for grasping the chain in the forward position;

means for pivotally mounting the grasping means between a first position adjacent a forward end of the throat plate when the chain is being grasped, and a second position away from and forward of the throat plate after the chain has been grasped to tighten the chain; and means for moving the grasping means between the first and second position.

10. The apparatus of claim 9 wherein the moving means comprises, a lever fixedly connected to the pivotally mounting means adjacent one end thereof, a piston pivotally connected to the lever adjacent the other end thereof, and means for moving the piston between first and second spaced locations to move the grasping means about the pivotally mounting means.

11. The apparatus of claim 10 wherein the piston moving means comprises a cylinder.

12. The apparatus of claim 10 including means for stopping movement of the piston at a desired adjustable second location.

13. The apparatus of claim 12 wherein the stopping means comprises an adjustable screw which bears against the lever at the second adjustable location.

* * * * *